US010364558B2

(12) United States Patent
Swadesh

(10) Patent No.: US 10,364,558 B2
(45) Date of Patent: Jul. 30, 2019

(54) BOTTLE TRAP

(71) Applicant: Kumar Gupta Swadesh, Uttar Pradesh (IN)

(72) Inventor: Kumar Gupta Swadesh, Uttar Pradesh (IN)

( * ) Notice: Subject to any disclaimer, the term of this patent is extended or adjusted under 35 U.S.C. 154(b) by 0 days.

(21) Appl. No.: 15/742,051

(22) PCT Filed: Jun. 22, 2016

(86) PCT No.: PCT/IN2016/000161
§ 371 (c)(1),
(2) Date: Jan. 5, 2018

(87) PCT Pub. No.: WO2017/006338
PCT Pub. Date: Jan. 12, 2017

(65) Prior Publication Data

US 2018/0195259 A1 Jul. 12, 2018

(30) Foreign Application Priority Data

Jul. 9, 2015 (IN) ..... 290/DEL/2015

(51) Int. Cl.
*E03C 1/29* (2006.01)
*E03C 1/30* (2006.01)

(52) U.S. Cl.
CPC . *E03C 1/29* (2013.01); *E03C 1/30* (2013.01)

(58) Field of Classification Search
CPC ..... E03C 1/29; E03C 1/30
USPC ..... 4/679, 256.1
See application file for complete search history.

(56) References Cited

U.S. PATENT DOCUMENTS 7,246,386 B2 * 7/2007 Hall ..... E03C 1/29 4/679
9,551,138 B2 * 1/2017 McLeod ..... E03C 1/22 4/679
2011/0036417 A1 2/2011 McAlpine

FOREIGN PATENT DOCUMENTS

EP 2228497 A1 * 9/2010 ..... E03C 1/29
GB 2384251 A 7/2003
JP 2003321860 A 11/2003
JP 2010037924 A 2/2010
WO WO-9112379 A1 * 8/1991 ..... E03C 1/29
WO 2008150255 A1 12/2008

OTHER PUBLICATIONS

International Search Report of PCT Patent Application No. PCT/IN2016/000161 dated Dec. 14, 2016.

* cited by examiner

*Primary Examiner* — Tuan N Nguyen

(57) ABSTRACT

Disclosed is a bottle trap having a main body having an open end coupled to a tailpiece pipe and a tapered closed end having at least one face inclined at a first angle with respect to axis of the main body. The bottle trap also includes a cylindrical trap element received on the open end and extending axially into the main body up to at least half the length of the main body. An outlet orifice is configured on peripheral surface of the main body perpendicularly thereto. The outlet orifice is adapted to be coupled to a horizontal drain pipe. Also, a thread-less coupling is configured at the open end and outlet orifice, respectively, for connecting the tailpiece pipe and the drain pipe, respectively, thereto for ensuring a leak-proof coupling. Moreover, at least one sealable drain orifice is configured at the at least one inclined face of the tapered closed end.

11 Claims, 5 Drawing Sheets

BOTTLE TRAP

FIELD OF THE DISCLOSURE

This invention relates to sanitary fittings, and more particularly, to an improvised bottle trap fitting that is easy to assemble, connect and clean upon a blockage being detected therein.

BACKGROUND OF THE DISCLOSURE

In today's world there is immense pressure on the drainage system of dwelling areas due to concentration of huge population. Consequently, such drainage systems are home to varied type of obnoxious and harmful gases. Such gases are harmful for humans and thus it is essential to prevent these gases from being discharged back into the drain pipes connecting the dwellings to the drainage system. Various systems have been developed to prevent this backward discharge of obnoxious gases, and one such system is a bottle trap. A conventional bottle trap includes a body having a U-shaped profile formed therein. Also an inlet adapted to receive a tail piece pipe coming from a sink/wash basin and an outlet adapted to receive a horizontal pipe coupled to a drainage system is also configured in the bottle trap.

Various bottle traps are known in the art. For instance U.S. Pat. No. 294,489 recites a removable bottle trap having a body of cylindrical cup form having a shell cast around a female screw to form a discharge-opening in its side and having its mouth spun into a neck and provided with a female screw. This enables the trap to be secured to and removed from the inlet and outlet pipes easily. In yet another prior art, US 20090308463, a bottle trap with integral gas seal is provided. The gas seal is disposed within the body. The bottle trap includes a body having an inlet adapted to receive a tail piece pipe, and an outlet adapted to receive a drain pipe. The outlet and inlet are coupled to the tail piece pipe and the drain pipe by way of screw and thread arrangement, as shown in FIG. 5 thereof.

In all conventional bottle traps, some of which are discussed above, the tail piece pipe is coupled to the inlet by means of complementary thread and screw arrangement. Also, the outlet is coupled to the horizontal pipe by means of yet another complementary thread and screw arrangement. Such connections require precision tightening by a skilled person, such as a plumber, so as to provide a leak-proof fit that sustains for a long period without requiring any replacement. Thus, a dwelling owner is required to depend upon the availability and skills of plumber to precision fit the bottle trap to the tail piece pipe and the horizontal pipe. This is a time consuming and cost intensive process.

Additionally, the thread and screw arrangement between the tail piece pipe and the inlet, and the outlet and horizontal pipe is prone to leakage over extended usage period. Moreover, the bottle trap body is made of at least two parts screwed together to form cylindrical shape. Such screwable parts are also prone to leakage over extended usage period.

Moreover, bottle traps generally get clogged with the waste material being thrown down the tail piece pipe and consequently to clear the clogging the entire bottle trap fittings need to be disassembled. Alternatively, one or more connections, such as between the inlet and the tail piece pipe or the outlet and the drain pipe needs, to the botte trap may have to be dismantled for cleaning the clogged bottle trap. After cleaning, the bottle trap needs to be re-assembled and/or dismantled connections need to be restored. This is a time consuming task and also requires the aid of a skilled personnel.

Accordingly, there exists a need for a bottle trap which is easy to configure and convenient to use.

There further exists a need for a bottle trap which can be assembled easily and coupled to drain pipes by user without requiring the services of a skilled personnel, such as a plumber.

There also exists a need for a bottle trap that incorporates leak-proof connections between the tail piece pipe and the inlet, and the horizontal pipe and the outlet.

Moreover, there exists a need for a bottle trap that can be cleaned easily and conveniently without dismantling the entire assembly/fitting without requiring the aid of skilled personnel, such as a plumber.

OBJECTS OF THE DISCLOSURE

In view of the foregoing disadvantages inherent in the prior art, the general purpose of the present invention is to provide a bottle trap for use with washbasin sinks.

Accordingly, an object of the present invention is to provide a bottle trap that is easily configurable and fixable to drain pipes in a convenient manner.

Another object of the present invention is to provide a bottle trap that can be assembled easily and coupled to drain pipes by user without requiring the services of a skilled personnel.

Yet another object of the present invention is to provide a bottle trap that incorporates a unique leak-proof connection between the tailpiece pipe and the inlet, and the horizontal pipe and the outlet.

Still another object of the present invention is to provide a bottle trap that incorporates a body that is not prone to leakage.

Still another object of the present invention is to provide a bottle trap that is easy to clean once clogging has been detected therein without disassembling the entire assembly.

These and other objects and advantages of the invention will be clear from the ensuing description.

SUMMARY OF THE DISCLOSURE

In light of the above objects, disclosed is a bottle trap for use with washbasin sinks.

The bottle trap of the present invention includes a main body having an open end and a tapered closed end. The open end is adapted to be coupled to a tailpiece pipe from a sink and the tapered closed end has at least one face inclined at a first angle with respect to axis of the main body. The bottle trap also includes a cylindrical trap element received on the open end and extending axially into the main body up to at least half the length of the main body. The cylindrical trap element divides the main body into an inner cylindrical portion and an outer cylindrical portion. The inner and the outer cylindrical portion are fluidically coupled. An outlet orifice is configured on peripheral surface of the main body perpendicularly thereto. The outlet orifice is fluidically coupled to the outer cylindrical portion and is adapted to be coupled to a horizontal drain pipe. Also, a thread-less coupling is configured at the open end and outlet orifice, respectively, for connecting the tailpiece pipe and the drain pipe, respectively, thereto for ensuring a leak-proof coupling. Moreover, at least one sealable drain orifice is configured at the at least one inclined face of the tapered closed end. The drain orifice is fluidically connected to the outer cylindrical portion for enabling draining out of blockage particles therein by opening the drain orifice. The present envisages that the main body is configured as monolithic block and joint free. Also, the at least one sealable drain orifice is adapted to be sealed by a removable closure. During operation, liquid from the tailpiece pipe enters into the inner cylinder towards outer cylinder for being directed out of the outlet orifice into the drain pipe.

In an aspect of the present invention, the thread-less coupling includes a connecting seal configured to have three-step annular groove.

In another aspect of the present invention, the connecting seal includes a cylindrical body having a first flange at one end and a second flange at another end configuring the three-step annular groove.

In yet another aspect of the present invention, each of the open end and the outlet orifice have complementary projections to mate with the three-step annular groove on respective connecting seal.

In still another aspect of the present invention, the connecting seal is made of any one of rubber, such as nitrile rubber and synthetic rubber, EPDM rubber and silicon rubber.

In still another aspect of the present invention, the removable closure is made of any one of rubber, such as nitrile rubber, synthetic rubber, EPDM rubber and silicon rubber.

In still another aspect of the present invention, the removable closure is made of any one of metal and plastic.

In still another aspect of the present invention, at least one inclined face of the tapered closed end is configured at an angle ranging between 20 degrees to 45 degrees with respect to the axis of the main body.

In still another aspect of the present invention, disclosed is a bottle trap fitting for washbasin sink. The bottle trap fitting includes a tailpiece pipe extending from a washbasin sink and a drain pipe extending from a drainage system and a bottle trap. The bottle trap includes a main body having an open end and a tapered closed end. The open end is adapted to be coupled to the tailpiece pipe from a sink and the tapered closed end has at least one face inclined at a first angle with respect to axis of the main body. The bottle trap also includes a cylindrical trap element received on the open end and extending axially into the main body up to at least half the length of the main body. The cylindrical trap element divides the main body into an inner cylindrical portion and an outer cylindrical portion. The inner and the outer cylindrical portion are fluidically coupled. An outlet orifice is configured on peripheral surface of the main body perpendicularly thereto. The outlet orifice is fluidically coupled to the outer cylindrical portion and is adapted to be coupled to the drain pipe. Also, a thread-less coupling is configured at the open end and outlet orifice, respectively, for connecting the tailpiece pipe and the drain pipe, respectively, thereto for ensuring a leak-proof coupling. Moreover, at least one sealable drain orifice is configured at the at least one inclined face of the tapered closed end. The drain orifice is fluidically connected to the outer cylindrical portion for enabling draining out of blockage particles therein by opening the drain orifice. The present envisages that the main body is configured as monolithic block and joint free. Also, the at least one sealable drain orifice is adapted to be sealed by a removable closure.

In yet another aspect of the present invention, the tailpiece pipe and the drain pipe are configured to have an axial bend such that axes of inlet and outlet of each of the pipes are displaced horizontally apart from each other.

These aspects together with other aspects of the present invention, along with the various features of novelty that characterize the present invention, are pointed out with particularity in the claims annexed hereto and form a part of this present invention. For a better understanding of the present invention, its operating advantages, and the specific objects attained by its uses, reference should be made to the accompanying drawing and descriptive matter in which there is illustrated an exemplary aspect of the present invention.

BRIEF DESCRIPTION OF THE DRAWINGS

The advantages and features of the present invention will become better understood with reference to the following detailed description taken in conjunction with the accompanying drawings, in which.

DETAILED DESCRIPTION OF THE DISCLOSURE

The exemplary embodiments described herein detail for illustrative purposes are subject to many variations in structure and design. It should be emphasized, however, that the present invention is not limited to a particular bottle trap as described. It is understood that various omissions and substitutions of equivalents are contemplated as circumstances may suggest or render expedient, but these are intended to cover the application or implementation without departing from the spirit or scope of the present invention.

The terms "a" and "an" herein do not denote a limitation of quantity, but rather denote the presence of at least one of the referenced item.

In addition, the terms "having", "comprising", "including", and variations thereof signify the presence of a component.

The present invention envisages an improved bottle trap that is easy to install by the user himself without the aid of a skilled personnel. The said bottle trap is envisaged to have features, as will be described in the ensuing paragraphs, which make the assembly and fitment thereof easy. Besides, the bottle trap ensures a leak-proof connection. Additionally, the present invention envisages that the bottle trap can be cleaned by the user himself without requiring the aid of a skilled personnel. The system and method, as envisaged by the present invention, will now be explained in conjunction with FIGS. 1 and 2 as below.

Figure 1:
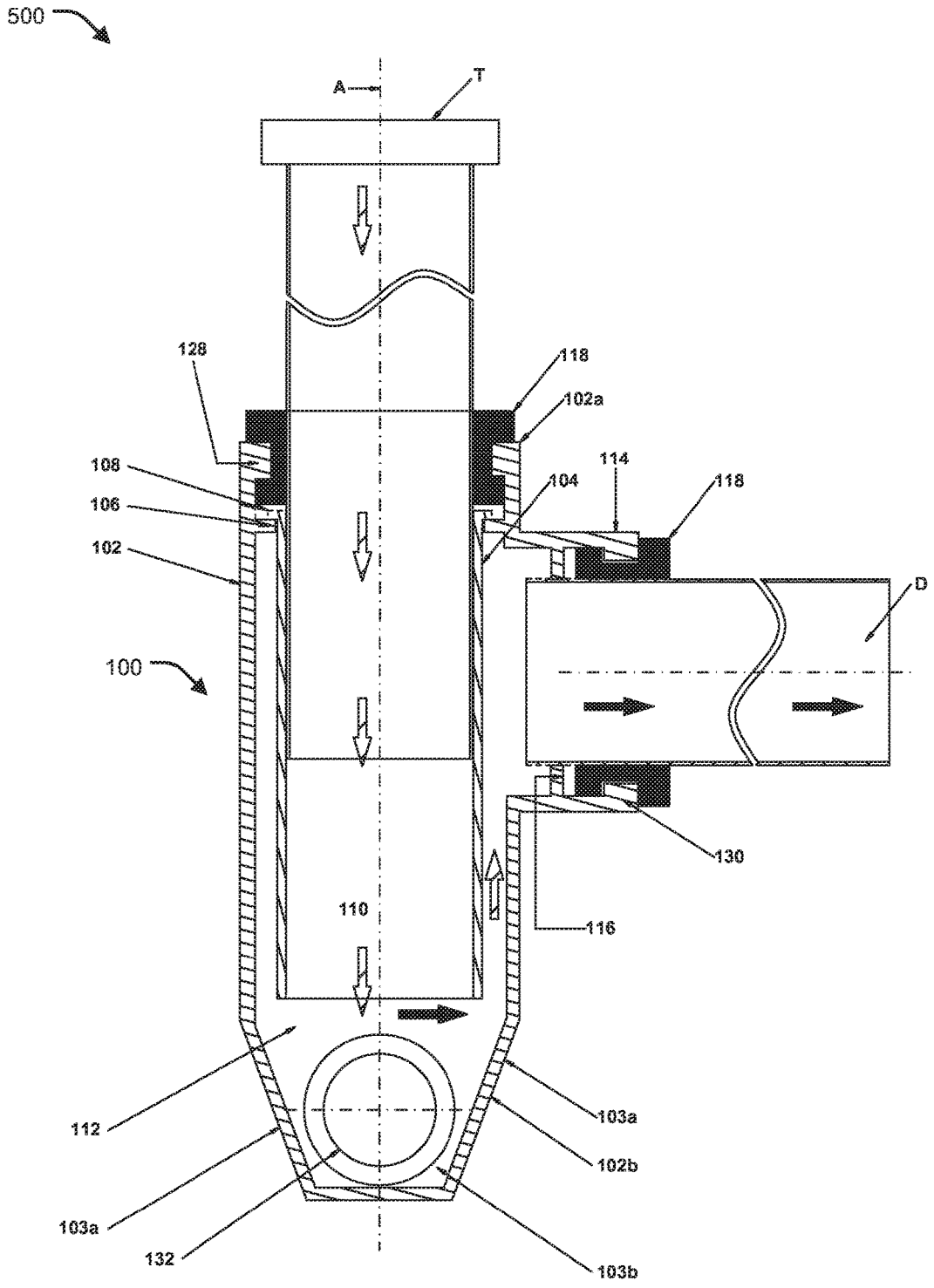
FIG. 1 illustrates a sectional view of a bottle trap, in accordance with an embodiment of the present invention.
Figure 2:
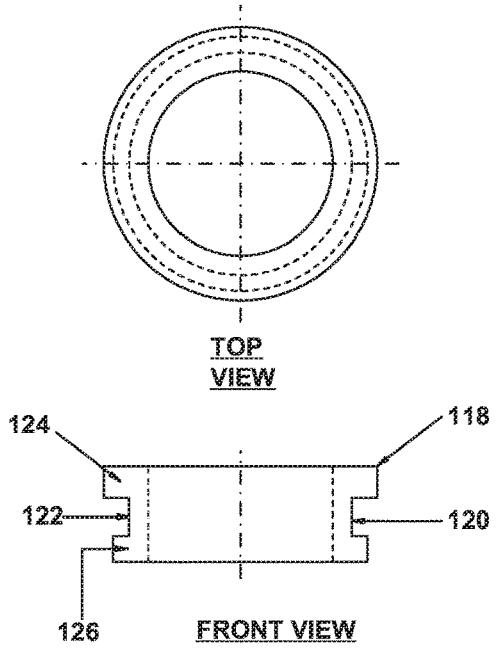
FIG. 2 illustrates a connecting seal as used in the bottle trap, in accordance with an embodiment of the present invention.

FIG. 1 illustrates a bottle trap fitting 500 having a bottle trap 100 in accordance with an embodiment of the present invention. The bottle trap 100 includes a main body 102, which is hollow, having an open end 102*a* and a closed end 102*b*. The main body 100 could be cylindrical, cubical, rectangular prism or any other shape. The present invention is being explained by referring to the main body 100 as having cylindrical shape. The open end 102*a* is adapted to receive therein a tailpiece pipe "T" coming from a washbasin sink (not shown). The closed end 102*b* is tapered. Particularly, the closed end 102*b* has at least one face inclined at a first angle with respect to axis 'A' of the cylindrical body 102. As shown in FIG. 1, two side inclined faces 103*a* and a front inclined face 103*b* of the closed end 102*b* are inclined at the first angle, ranging between 20 degrees to 45 degrees, with respect to the axis 'A'. In an embodiment of the present application as described in FIG. 1, the faces are inclined at an angle of 20 degrees with respect to the axis 'A'. Further, the cylindrical body 102 is configured as monolithic block and is joint-free.

To enable the bottle trap to perform the function of inhibiting backflow of obnoxious gases of drainage system, the present invention envisages that a cylindrical trap element 104 is snuggly fitted in the open end 102*a*. Particularly, the open end 102*a* has an annular projection 106 on which rests an annular skirt portion 108 of the cylindrical trap element 104, as shown in FIG. 1. The cylindrical trap element 104 is hollow and extends axially into the substantially cylindrical body 102 up to at least half the length of the cylindrical body 102. As a result of such positioning of the trap element 104, the hollow space of the cylindrical body 102 is divided into an inner cylindrical portion 110 and an annular outer cylindrical portion 112. In an embodiment of the present invention, the trap element 104 may be made of plastic material, such as PVC. It will be evident that the inner cylindrical portion 110 and the outer cylindrical portion 112 are fluidically coupled to each other, which means that fluid entering the inner cylindrical portion 110 can easily flow into the outer cylindrical portion 112.

The cylindrical body 102 further includes an outlet orifice 114 configured on peripheral surface of the substantially cylindrical body 102, as shown, and extending in a direction perpendicular to the axis 'A' thereof. The outlet orifice 114 is fluidically coupled to the outer cylindrical portion 112 such that fluid in outer cylindrical portion 112 can easily flow into the outlet orifice 114. The outlet orifice 114 is adapted to be coupled to a horizontal drain pipe 'D' that leads into a drainage system. As shown, the outlet orifice 114 includes an annular projection 116 configured therein for receiving the drain pipe 'D', thereby securing the horizontal pipe 'D' concentrically within the outlet orifice 114. The outlet orifice 114 is configured at a position such that the drain pipe 'D' is always displaced vertically above relative to the opening of the tailpiece pipe 'T' within the cylindrical body 102. This helps to prevent obnoxious gases from being drawn back through the tailpiece pipe 'T' into the dwelling place environment.

To achieve the intended objective of providing a leak-proof connection of the tailpiece pipe 'T' and the drain pipe 'D' to the bottle trap 100, the present invention envisages that a thread-less coupling 118 is configured at the open end 102*a* and outlet orifice 114, respectively. In an embodiment of the present invention, the thread-less coupling 118 includes a connecting seal. The connecting seal 118 is shown in detail in FIG. 2. As shown, the connecting seal 118 is configured to have three-step annular groove 120. Particularly, the connecting seal 118 is made of a cylindrical body 122 having a first flange 124 configured at one end and a second flange 126 configured at another end thereof. The cylindrical body 122 between the two flanges makes the three-step annular groove 120. In an embodiment of the present invention, the connecting seal 118 is made of natural rubber. In another embodiment, the connecting seal 118 may be made from nitrile rubber, EPDM rubber or any other type of synthetic rubber.

For configuring the connecting seal 118 on the open end 102*a* and the outlet orifice 114, each of the open end 102*a* and the outlet orifice 114 have complementary projections configured thereon that mates with the three-step annular groove 120 on respective connecting seals 118. As shown in FIG. 1, the open end 102*a* is configured to have an annular projection 128 adjacent to the periphery thereof, which mates with the annular groove 120 when the connecting seal 118 is received on the open end 102*a*. As the connecting seal 118 is made of pliant material, such as natural, synthetic rubber, nitrile rubber, EPDM, silicon or any other type of rubber, it can be easily pressed into the open end 102*a* for enabling the annular projection 128 to be received in the annular groove 120 of the connecting seal 118, thereby securing the connecting seal 118 to the open end 102*a*. It will be evident that when the connecting seal 118 is pushed through the open end 102*a*, the second flange 126 thereof moves over the annular projection 128 owing to pliant nature of the material and thereafter the annular groove 120 receives the annular projection 128 to secure the connecting seal 118 to open end 102*a*.

In an aspect, inner hole of the connecting seal 118 can be sized to provide an interference tight fit with the tailpiece pipe 'T' to enable a leak proof joint. In an exemplary application interference between the connecting seal 118 and the tailpiece pipe 'T' can be 1 mm on diameter. Pliant nature of material for the connecting seal 118 shall allow the tailpiece pipe 'T' to be fitted through the connecting seal 118.

Similarly, the outlet orifice 114 has an annular projection 130 that is adapted to be received in annular groove 120 of connecting seal 118 configured at the outlet orifice 114. The annular projection 130 is configured similar to the annular projection 128 of the open end 102*a* and therefore, a detailed description in this respect is being avoided for the sake of brevity.

To couple the tailpiece pipe 'T' to the open end 102*a*, the connecting seal 118 is first configured at the open end 102*a*, as explained above, and thereafter the tailpiece pipe 'T' is slid through the connecting seal 118 into the cylindrical body 102 and more particularly the trap element 104 configured in the cylindrical body 102, as shown in FIG. 1. Thus, the tailpiece pipe 'T' is fluidically coupled to the inner cylindrical portion 110. Similarly, to couple the drain pipe 'D' to the outlet orifice 114, the connecting seal 118 is configured at the outlet orifice 114, as explained above, and the drain pipe 'D' is inserted through the connecting seal 118 into the outlet orifice 104. Consequently, a thread less coupling is ensured between the open end 102*a* and the tailpiece pipe 'T', and the outlet orifice 114 and the drain pipe 'D'.

Figure 4:
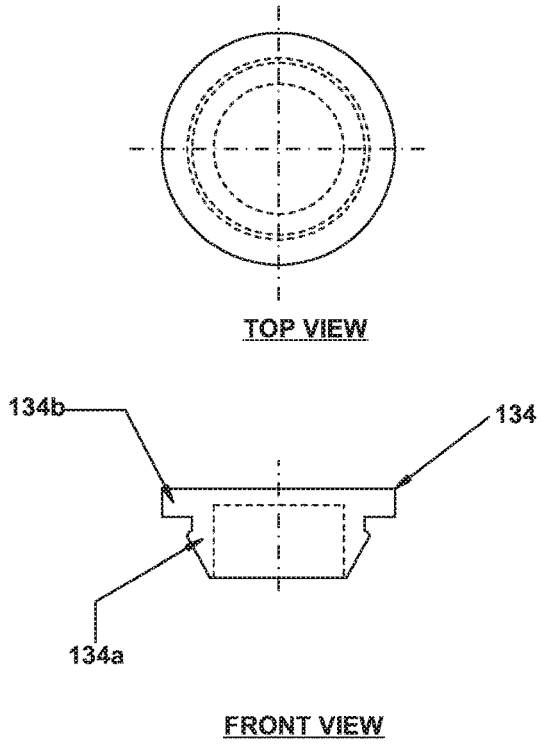
FIG. 4 illustrates a removable closure used in the bottle trap of FIG. 1.
Figure 3:
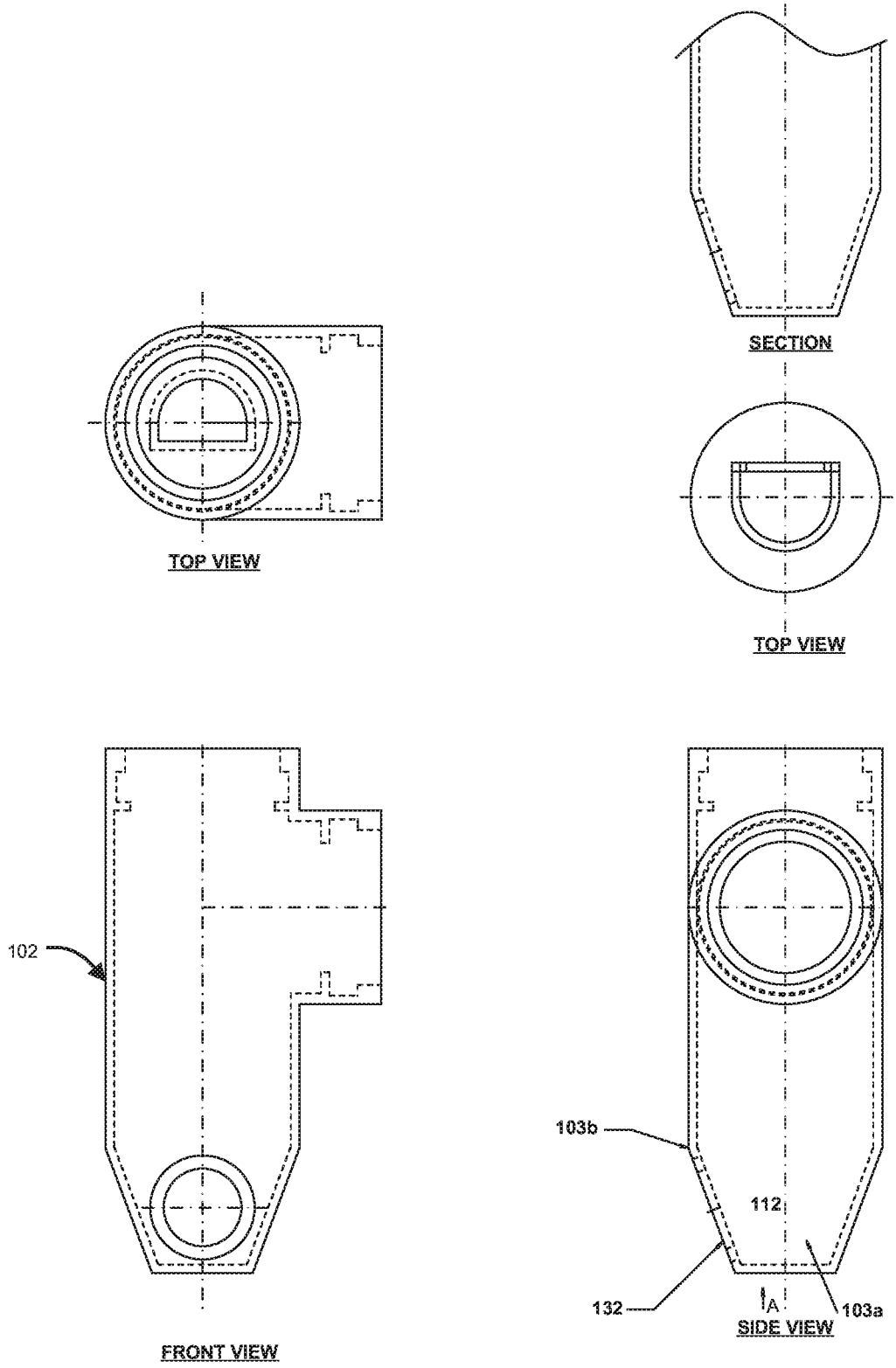
FIG. 3 illustrates a side view of the bottle trap of FIG. 1, in accordance with an embodiment of the present invention.
Figure 5:
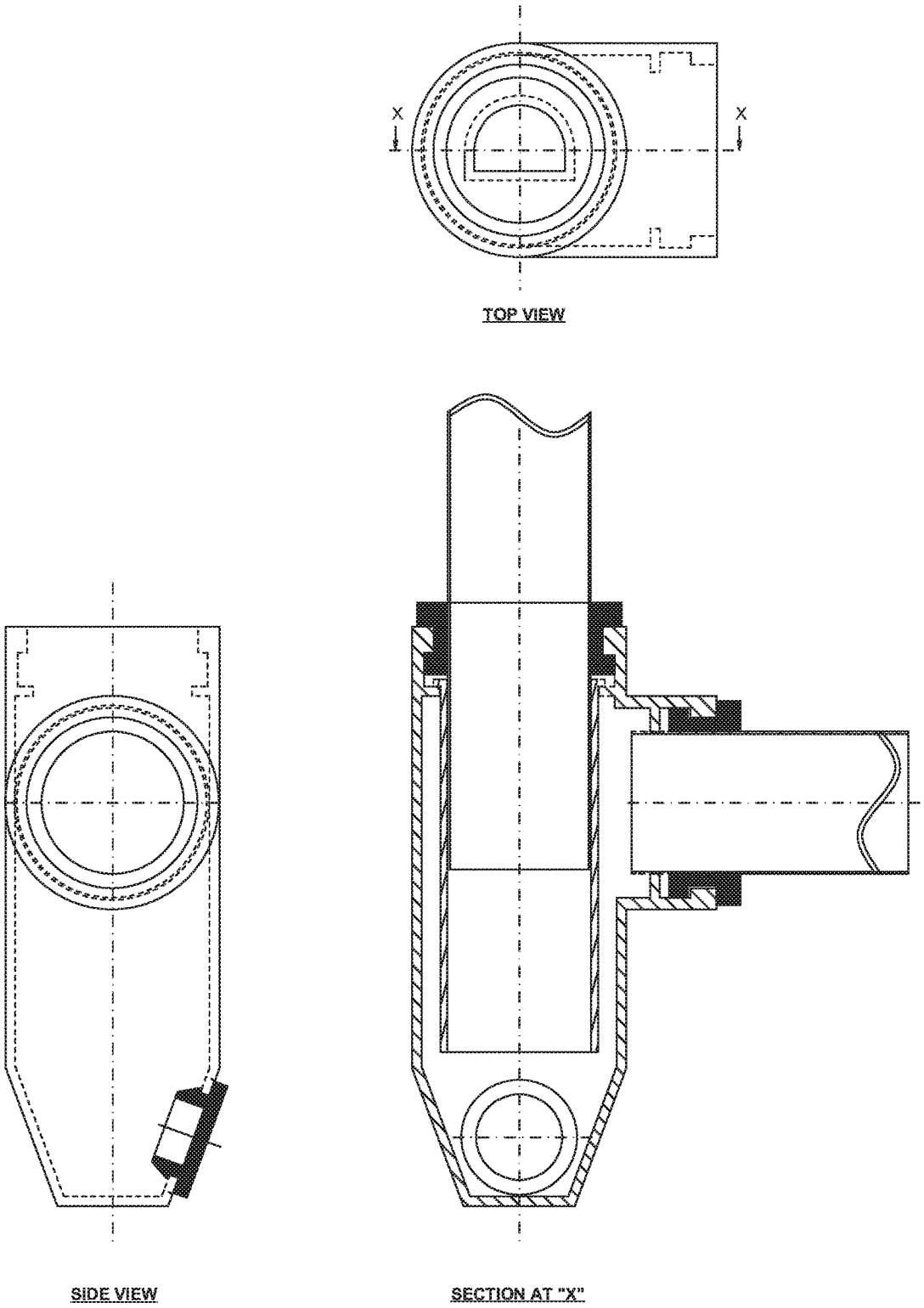
FIG. 5 illustrates the removable closure received on a drain orifice of the bottle trap.
Figure 6:
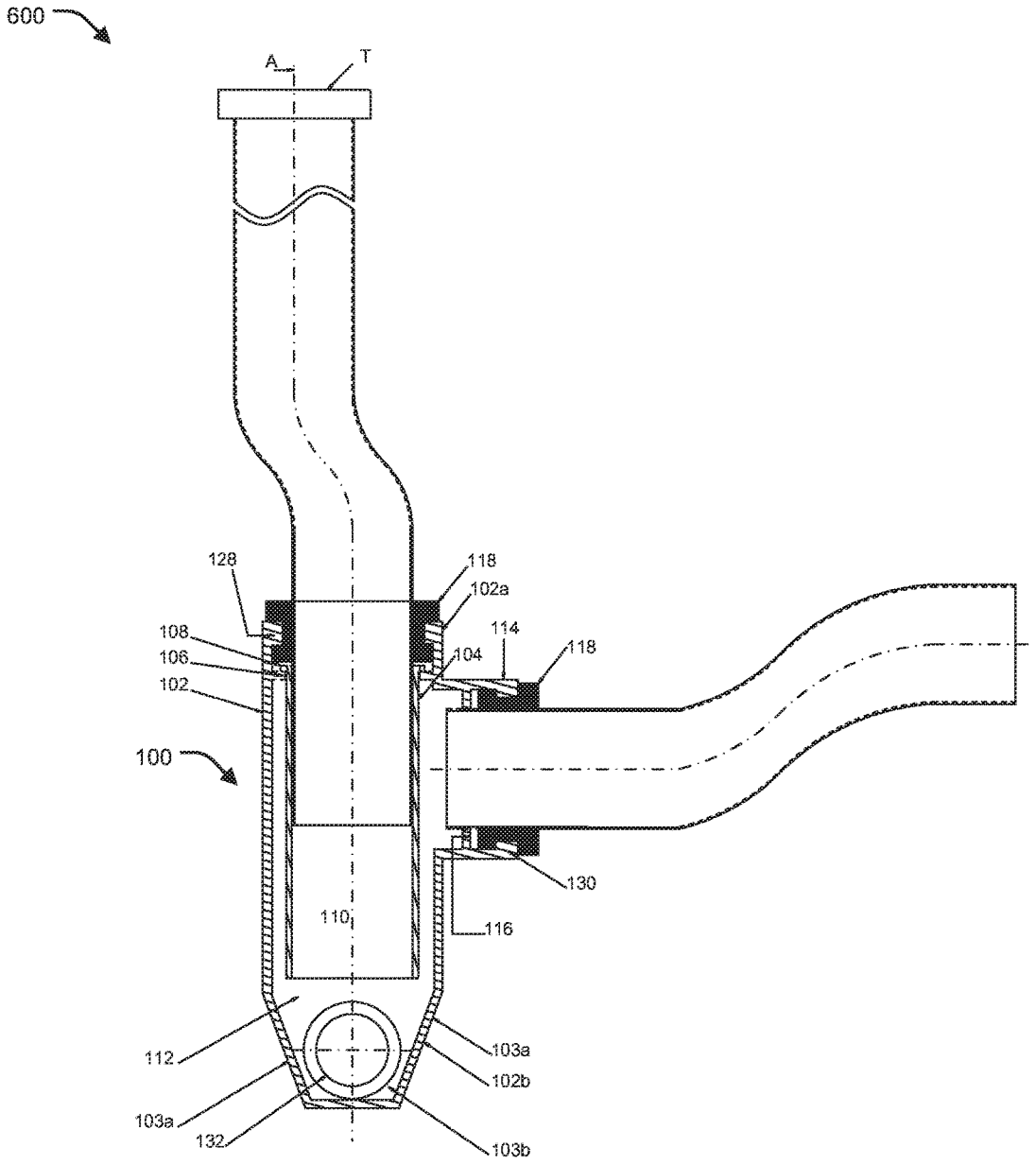
FIG. 6, illustrates a bottle fitting 600 having tailpiece pipe and drain pipe, in accordance with an embodiment of the present invention.

Further, to enable yet another intended objective of ensuring easy cleaning of the bottle trap, the present invention envisages that at least one sealable drain orifice 132 is configured at the at least one inclined face of the tapered closed end 102*b*. In the described embodiment, the drain orifice 132 is configured on the front inclined face 103*b*, as is evident upon referring to FIG. 3, which is a side view of the bottle trap 100. In an embodiment, the front inclined face 103*b* is the one which is positioned towards right side of the face facing a user when the bottle trap has been fitted. The drain orifice 132 is fluidically connected to the outer cylindrical portion 112, for enabling draining out of any blockage particles therein. Particularly, the drain orifice 132 is sealable by a removable closure 134, shown in FIG. 4. The removable closure 134 is received on the drain orifice 132, as shown in FIG. 5, to seal the same ordinarily and removed whenever there is any clogging or blockage in the bottle trap so as drain out the material stuck therein. In an embodiment of the present invention, the removable closure 134 is configured to have a frustoconical body 134*a* coupled to a flange 134*b*. The frustoconical body 134*a* is received within the drain orifice 132 and the flange 134*b* enables a user to hold the same and pull the removable closure 134 from the drain orifice 132 when required. In an embodiment, the removable closure 134 may be made from any one of rubber such as nitrile rubber, synthetic rubber EPDM rubber and silicon rubber. In another embodiment, the removable closure 134 may be made of metal or plastic and fitted to the drain orifice 132 by means of thread and screw arrangement on closure 134 and orifice 132, respectively. Such a connection would also lie within the scope of the present invention.

As is evident from the foregoing, the bottle trap is easy to install. A user can easily assemble the same by first installing the cylindrical trap element 104 within the cylindrical body 102, thereafter installing the connecting seals 118 at the open end 102*a* and the outlet orifice 114 and subsequently sliding the tailpiece pipe 'T' and the drain pipe 'D' through the connecting seals 118 at the open end 102*a* and the outlet orifice 114, respectively. The tailpiece pipe 'T' is slid into the cylindrical body up to a depth such that the opening thereof is displaced vertically below relative to the outlet orifice 114, for enabling the bottle trap to effectively block backflow of obnoxious gases. Thus, the bottle trap 100 is easily installable without requiring any professional help.

In use, water from the sink enters (as shown by dark arrows in FIG. 1) through the inner cylindrical portion 110 and fills up the outer cylindrical portion 112. Any obnoxious gases flowing back into the drain pipe 'D' are prevented from entering the tailpiece pipe 'T' by means of the cylindrical trap element 104. In the event, the bottle trap 100 experiences any clogging, a user can easily remove the removable closure 134 and drain out any clogging materials through the drain orifice 132 from within the cylindrical body 102 of the bottle trap 100. Since the drain orifice 132 is configured at the inclined face 103*b*, there is no risk of water/material being drained out from being splashed at the face of the user. Thus, the bottle trap 100 is easily cleanable without requiring the aid of a skilled person. Also, owing to the cylindrical body 100 being a monolithic block without any joints, there are no chances of leakages as encountered in conventional bottle traps.

Various modifications are envisaged. For instance the tailpiece pipe 'T' and the drain pipe 'D' may be configured to have an axial bend along the length thereof Δn exemplary embodiment of the bottle trap fitting, referred with reference numeral 600. The bottle trap 600 includes a bottle trap, similar to bottle trap 100, and tailpiece pipe and drain pipes having axial bends. Particularly, the axial bend is such that axes of inlet and outlet of the pipes are displaced horizontally apart from each other. More particularly, the tailpiece pipe and the drain pipe are not straight and the inlet and outlet of each the pipes are parallelly aligned but separated by a pre-determined distance perpendicularly to the axis thereof. This enables the bottle trap fitting 600 to be fixed to a washbasin sink and drainage system pipes even if any or both of the same are positioned obliquely vis-à-vis the position of the bottle trap. Moreover, in an embodiment, the bottle trap 100 may be made of any metal such as brass and there after coated with nickel and Chromium for smooth finish.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The embodiments were chosen and described in order to best explain the principles of the present invention and its practical application, and to thereby enable others skilled in the art to best utilize the present invention and various embodiments with various modifications as are suited to the particular use contemplated. It is understood that various omissions and substitutions of equivalents are contemplated as circumstances may suggest or render expedient, but such omissions and substitutions are intended to cover the application or implementation without departing from the spirit or scope of the present invention.

I claim:

1. A bottle trap for washbasin sink, the bottle trap comprising:

a main body having an open end and a tapered closed end, the open end adapted to be coupled to a tailpiece pipe from a sink and the tapered closed end has at least one face inclined at a first angle with respect to a longitudinal axis of the main body;

a cylindrical trap element received through the open end and extending axially into the main body up to at least half the length of the main body, the cylindrical trap element dividing the main body into an inner cylindrical portion and an outer cylindrical portion, the inner cylindrical portion and the outer cylindrical portion being fluidically coupled;

an outlet orifice provided on peripheral surface of the main body perpendicularly thereto, the outlet orifice is fluidically coupled to the outer cylindrical portion and is adapted to be coupled to a horizontal drain pipe;

a thread-less coupling provided at the open end and the outlet orifice, for connecting the tailpiece pipe and the drain pipe, respectively, thereto for ensuring a leak-proof coupling, said thread-less coupling being based on a connecting seal having a cylindrical body with a circumferential groove on its outer cylindrical surface, and a complementary inward projecting first annular projection on the open end and the outlet orifice, the first annular projection being adapted to engage with the circumferential groove on the respective connecting seal; and at least one sealable drain orifice provided at the at least one inclined face of the tapered closed end, the drain orifice being fluidically connected to the outer cylindrical portion for enabling draining out of blockage particles therein by opening the drain orifice, wherein the main body is a monolithic block and joint free, and wherein the at least one sealable drain orifice is adapted to be sealed by a removable closure, and wherein during operation liquid from the tailpiece pipe enters into the inner cylinder portion towards the outer cylinder portion for being directed out of the outlet orifice into the drain pipe.

2. The bottle trap as claimed in claim 1, wherein the inner cylindrical surface of the respective connecting seal is sized for tight fit with the tailpiece pipe and the drain pipe.

3. The bottle trap as claimed in claim 2, wherein an end of the cylindrical trap element has an outwardly projecting annular skirt portion, and the main body has an inward projecting second annular projection located near the open end of the main body inward of the first annular projection, and wherein first annular projection, the second annular projection and the annular skirt portion are sized to enable main body to receive the trap element through the open with the end of the trap element having annular skirt portion being last to enter the open end.

4. The bottle trap as claimed in claim 3, wherein the annular skirt portion of the trap element and the second annular projection of the main body are sized such that, on insertion of the trap element in the main body through the open end, the annular skirt portion on the trap element rests on the second annular projection of the main body.

5. The bottle trap as claimed in claim 1, wherein the connecting seal is made of any one of rubber, nitrile rubber and synthetic rubber.

6. The bottle trap as claimed in claim 1, wherein the removable closure is made of any one of rubber, nitrile rubber, synthetic rubber, EPDM rubber.

7. The bottle trap as claimed in claim 1, wherein the removable closure is made of any one of metal and plastic.

8. The bottle trap as claimed in claim 1, wherein the at least one inclined face of the tapered closed end, on which the at least one sealable drain orifice is provided, is located at right side of user at an angle ranging between 20 degrees to 45 degrees with respect to the longitudinal axis of the main body.

9. A bottle trap fitting for washbasin sink, the bottle trap fitting comprising:

a tailpiece pipe extending from a washbasin sink and a drain pipe extending from a drainage system; and a bottle trap comprising a main body having an open end and a tapered closed end, the open end adapted to be coupled to the tailpiece pipe and the tapered closed end has at least one face inclined at a first angle with respect to a longitudinal axis of the main body;

a cylindrical trap element received through the open end and extending axially into the main body up to at least half the length of the main body, the cylindrical trap element dividing the main body into an inner cylindrical portion and an outer cylindrical portion, the inner and the outer cylindrical portion being fluidically coupled;

an outlet orifice provided on peripheral surface of the main body perpendicularly thereto, the outlet orifice is fluidically coupled to the outer cylindrical portion and is adapted to be coupled to the drain pipe;

a thread-less coupling provided at the open end and outlet orifice, respectively, for connecting the tailpiece pipe and the drain pipe, respectively, thereto for ensuring a leak-proof coupling; and at least one sealable drain orifice provided at the at least one inclined face of the tapered closed end, the drain orifice being fluidically connected to the outer cylindrical portion for enabling draining out of blockage particles therein by opening the drain orifice, wherein the main body is a monolithic block and joint free;

wherein the at least one sealable drain orifice is adapted to be sealed by a removable closure;

wherein during operation liquid from the tailpiece pipe enters into the inner cylinder portion towards the outer cylinder portion for being directed out of the outlet orifice into the drain pipe; and wherein the tailpiece pipe and the drain pipe have an axial bend such that axes of inlet hole and outlet hole of each of the tailpiece pipe and the drain pipe are displaced apart from each other.

10. The bottle trap fitting as claimed in claim 9, wherein the thread-less coupling is based on a connecting seal having a cylindrical body with a circumferential groove on its outer cylindrical surface, and a complementary inward projecting first annular projection on the open end and the outlet orifice, the first annular projection being adapted to engage with the circumferential groove on the respective connecting seal.

11. The bottle trap as claimed in claim 10, wherein the connecting seal is made of any one of rubber, nitrile rubber and synthetic rubber.

* * * * *